US011089886B2

(12) United States Patent
Diaz et al.

(10) Patent No.: US 11,089,886 B2
(45) Date of Patent: Aug. 17, 2021

(54) SINGLE ACTION ASSEMBLY TEMPORARY DISPLAY

(71) Applicant: Central Graphics and Container Group Ltd., Mississauga (CA)

(72) Inventors: Jun Diaz, Mississauga (CA); Madelaine Vieira, Mississauga (CA)

(73) Assignee: Central Graphics and Container Group Ltd., Mississauga (CA)

( * ) Notice: Subject to any disclaimer, the term of this patent is extended or adjusted under 35 U.S.C. 154(b) by 0 days.

(21) Appl. No.: 16/906,620

(22) Filed: Jun. 19, 2020

(65) Prior Publication Data

US 2020/0397155 A1 Dec. 24, 2020

Related U.S. Application Data

(60) Provisional application No. 62/864,034, filed on Jun. 20, 2019.

(51) Int. Cl.
*A47F 5/11* (2006.01)
*A47F 5/10* (2006.01)

(52) U.S. Cl.
CPC ..... *A47F 5/116* (2013.01); *A47F 5/105* (2013.01); *A47F 5/118* (2013.01)

(58) Field of Classification Search
CPC ..... A47F 5/116; A47F 5/105; A47F 7/145; A47F 5/114; A47F 5/118; A47B 47/042; A47B 2220/0083; A47B 47/0091; A47B 43/00; A47B 47/0025
See application file for complete search history.

(56) References Cited

U.S. PATENT DOCUMENTS 3,901,572 A * 8/1975 Litchfield ..... A47B 88/941 312/348.2
4,108,520 A * 8/1978 Litchfield ..... A47B 88/941 312/348.2
4,389,133 A * 6/1983 Oberst ..... A47B 47/06 403/230
4,582,003 A * 4/1986 Valero ..... A47F 5/116 108/179
4,828,133 A * 5/1989 Hougendobler ... B65D 5/48024 220/533
4,929,116 A * 5/1990 Mahl ..... A47B 43/02 403/263
4,976,567 A * 12/1990 Spier ..... A47B 43/00 24/297
5,392,902 A * 2/1995 Vlastakis ..... A47B 57/00 108/165
5,632,390 A * 5/1997 Podergois ..... A47F 5/116 211/149

(Continued)

*Primary Examiner* — Ko H Chan
(74) *Attorney, Agent, or Firm* — Head, Johnson, Kachigian & Wilkinson, PC

(57) ABSTRACT

A pop-up display apparatus. The apparatus includes a knuckle defining a pivot axis and having a pair of parts, the pair of parts being pivotally connected to one another for relative movement about the pivot axis. A base portion is connected to one of the pair of parts. The apparatus includes a leaf portion connected to the other of the pair of parts for pivotal movement relative to the base portion about the pivot axis and a tab portion movable relative to the leaf portion between a released position and an engaged position.

5 Claims, 12 Drawing Sheets

(56) References Cited

U.S. PATENT DOCUMENTS

| | | | | |
|---|---|---|---|---|
| 5,944,439 | A * | 8/1999 | Ellsworth | F16B 12/50 403/231 |
| 8,286,809 | B2 * | 10/2012 | Mestres Armengol | A47F 5/112 211/149 |
| 8,454,262 | B2 * | 6/2013 | Norman | B65D 13/04 403/331 |
| 10,624,472 | B2 * | 4/2020 | Lopez Fernandez | B65D 5/5206 |
| 2004/0016375 | A1 * | 1/2004 | Grueneberg | A47B 43/02 108/115 |
| 2009/0284111 | A1 * | 11/2009 | Hazzard | A47B 17/006 312/265.6 |
| 2013/0233819 | A1 * | 9/2013 | Kwo | F16B 12/26 211/153 |
| 2014/0014606 | A1 * | 1/2014 | Mestres Armengol | A47F 5/116 211/135 |

* cited by examiner

SINGLE ACTION ASSEMBLY TEMPORARY DISPLAY

CROSS-REFERENCE TO RELATED APPLICATION

This application claims priority to U.S. Provisional Patent Application Ser. No. 62/864,034, filed Jun. 20, 2019.

BACKGROUND OF THE INVENTION

1. Field of the Invention

The invention relates to the field of pop-up displays.

2. Prior Art

Pop-up displays of many types are known.

SUMMARY OF THE INVENTION

Forming one aspect of the invention is apparatus comprising a knuckle, a base portion, a leaf portion and a tab portion.

The knuckle defines a pivot axis and has a pair of parts, the pair of parts being pivotably connected to one another for relative movement about the pivot axis.

The base portion is connected to one of the pair of parts.

The leaf portion:

- is connected to the other of the pair of parts for pivotal movement relative to the base portion about the pivot axis: has an extension axis and a length associated with the extension axis;
- extends from the other of the pair of parts along the extension axis; and
- is shaped and dimensioned such that the cross-section of the leaf portion, throughout the length of the leaf portion, has a substantially constant perimeter.

The tab portion:

- has an extension axis and a length associated with the extension axis;
- extends from the leaf portion along the extension axis; and
- is movable relative to the leaf portion between a released position and an engaged position,
  - the released position being such that the extension axis of the tab portion is substantially parallel to the extension axis of the leaf portion and the tab portion extends towards the other of the pair of parts,
  - the engaged position being such that the extension axis of the tab portion is disposed in angular relation to the extension axis of the leaf portion.

According to another aspect, the tab portion can be resilient and be biased for movement to the engaged position.

According to another aspect, the tab portion can be formed integrally with the leaf.

According to another aspect, the leaf portion can define an aperture and the tab portion can occupy the aperture when the tab portion is in the released position.

According to another aspect, the base portion can be planar and the one of the pair of parts can be disposed to one side and centrally of the base portion.

According to another aspect, the pivot axis can be parallel to the base portion.

According to another aspect, the leaf portion can be planar.

According to another aspect, the pivot axis can be parallel to the leaf portion.

According to another aspect, the plane defined by the leaf portion can be coincident with the pivot axis.

According to another aspect, the apparatus can form, along with a pair of components, a joint.

In the joint:

- the tab portion is in the engaged position;
- one of the pair of components has defined therewithin a chamber and an aperture communicating with the chamber, the chamber being in gripping receipt of the leaf portion and the tab portion and having the other of the pair of parts protruding therefrom; and
- the other of the pair of components defines a channel, the channel having the one of the pair of parts protruding therefrom and being in close-fitting relation thereto.

According to another aspect, the other of the pair of components can have defined therein a slit intersecting the channel such that the channel extends therefrom, the slit and the other of the pair of components being adapted such that the one of the pair of parts can be positioned in the channel by passing the base through the slit.

According to another aspect, one of the pair of components can comprise a cardboard tube that grippingly receives the leaf portion, the tube having a sidewall and, defined within the sidewall, an aperture, the aperture defining that part of the chamber that grippingly receives the tab portion.

According to another aspect, the other of the pair of components can comprise a pair of cardboard layers, one of the layers having defined therewithin the channel and the slit.

Forming another aspect of the invention is a structure comprising:

- an elongate beam having a longitudinal axis and a pair of ends, each end defining a pivot axis;
- a shelf pivotably connected to the beam for movement about the longitudinal axis between
  - a nested position, whereat the shelf is generally coplanar with the beam; and
  - a supporting position, whereat the shelf is disposed in angular relation to the beam,
- a frame including
  - for each end of the beam, a sidewall, the sidewall connected to the beam end for which it is provided for movement about the pivot axis defined thereby, between
    - a nested position, whereat the sidewall is generally coplanar with the beam and extends away from the beam; and
    - a supporting position, whereat the sidewall is disposed in angular relation to the beam; and
  - a planar support movable between
    - a nested position, whereat, when the shelf is in the nested position, the support is generally coplanar with the beam; and
    - a supporting position, whereat, when the shelf is in the support position thereof, the support is disposed in parallel, spaced relation to the beam,
- a linkage coupling the sidewalls, support and shelf together such that
  - the following movements are mechanically linked to one another
    - movement of the shelf from the nested position to the supporting position;
    - movement of each sidewall from the nested position to the supporting position;

movement of the support from the nesting position to the supporting position.

the shelf extends to, and is supported by, the support when the shelf is in the supporting position.

According to another aspect, the linkage can comprise:

a shelf brace extending from the support to a midpoint of the shelf and upon which the shelf sits when in its supporting position; and for each sidewall, a sidewall brace, to which said each sidewall extends and which extends to the support.

According to another aspect:

the shelf brace can be planar and be pivotally connected to each of the shelf and the support; and each sidewall brace can be planar and be pivotally connected to the sidewall for which it is provided and to the support.

According to another aspect, the hinge can be used to provide for the pivotal connection between the beam and the sidewall.

According to another aspect, the joint can define the connection between the beam and the sidewall, the one of the pair of components being defined by the beam and the other of the pair of components being defined by the sidewall.

Advantages, features and characteristics of the invention will be apparent to persons of ordinary skill in the art upon review of the following detailed description, with reference to the appended drawings, the latter being briefly described hereinafter.

DETAILED DESCRIPTION OF THE EXEMPLARY EMBODIMENT

Hinge

Figure 1:
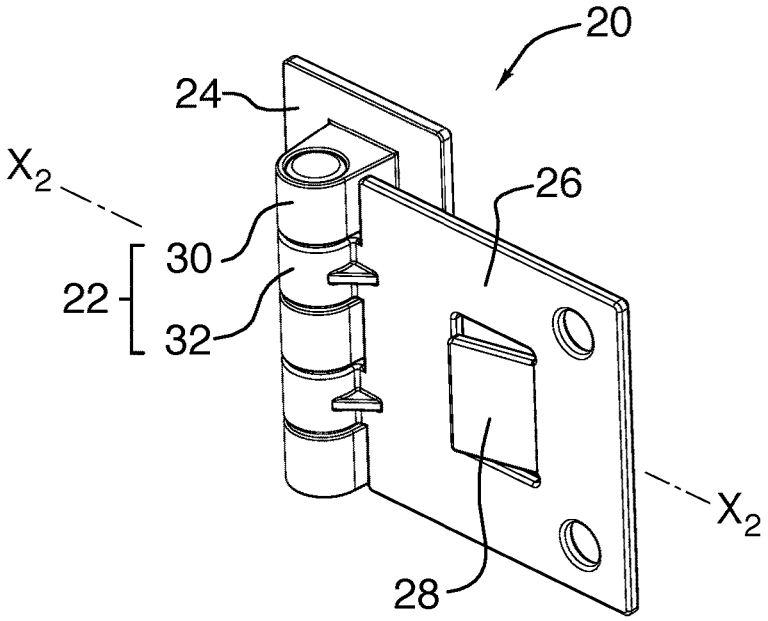
FIG. 1 is a top, front, right side view of apparatus according to an embodiment of the invention.
Figure 4:
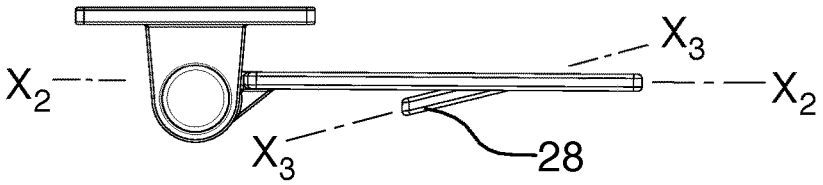
FIG. 4 is a top view of the apparatus of FIG. 1.
Figure 2:
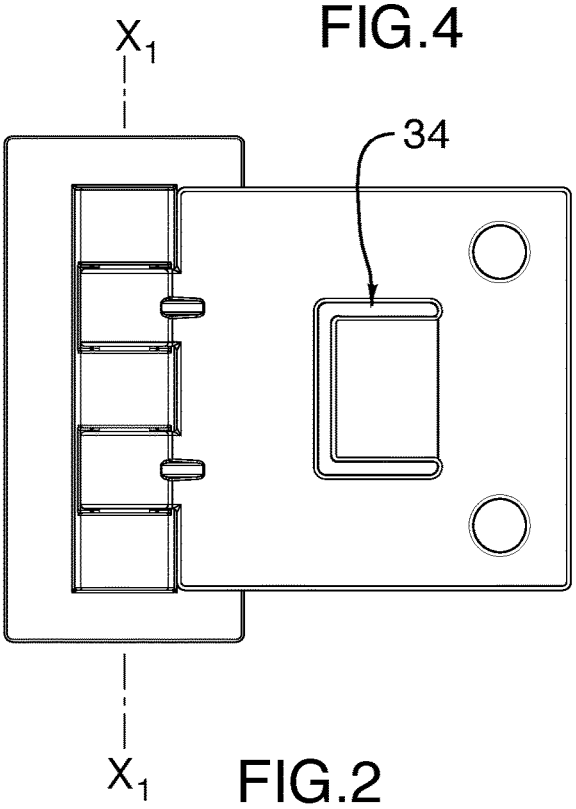
FIG. 2 is a front view of the apparatus of FIG. 1.
Figure 3:
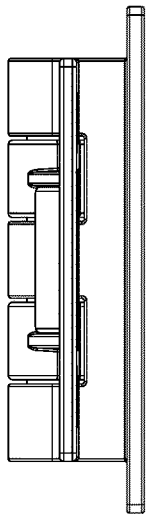
FIG. 3 is a right side view of the apparatus of FIG. 1.

Forming one embodiment of the invention is apparatus 20 comprising a knuckle 22, a base portion 24, a leaf portion 26 and a tab portion 28, all as shown in FIGS. 1-4

The knuckle defines a pivot axis X1-X1 and has a pair of parts 30, 32, the pair of parts being pivotably connected to one another for relative movement about the pivot axis X1-X1.

Base portion 24 is planar and is connected to one 30 of the pair of parts such that said one 30 of the pair of parts is disposed to one side and centrally of the base portion 24 and such that the pivot axis X1-X1 is parallel to the base portion.

The leaf portion 26: is connected to the other 32 of the pair of parts for pivotal movement relative to the base portion about the pivot axis X1-X1; is planar and parallel to the pivot axis X1-X1; defines an aperture 34; has an extension axis X2-X2 and a length associated with the extension axis; extends from the other 32 of the pair of parts along the extension axis X2-X2; and is shaped and dimensioned such that the cross-section of the leaf portion 26, throughout the length of the leaf portion, has a substantially constant perimeter.

The tab portion 28 is formed integrally with the leaf portion 26;

has an extension axis X3-X3 and a length associated with the extension axis;

extends from the leaf portion 26 along the extension axis X3-X3 and generally towards the other 32 of the pair of parts;

in FIGS. 1-4, is shown in an engaged position, the engaged position being such that the extension axis X3-X3 of the tab portion 28 is disposed in angular relation to the extension axis X2-X2 of the leaf portion 26; and is resilient, to permit movement from the engaged position, against spring bias, to a disengaged position, not shown, whereat the tab portion 28 occupies the aperture 34 and whereat the extension axis of the tab portion is substantially parallel to the extension axis of the leaf portion and the tab portion extends towards the other of the pair of parts.

Joint

Figure 5:
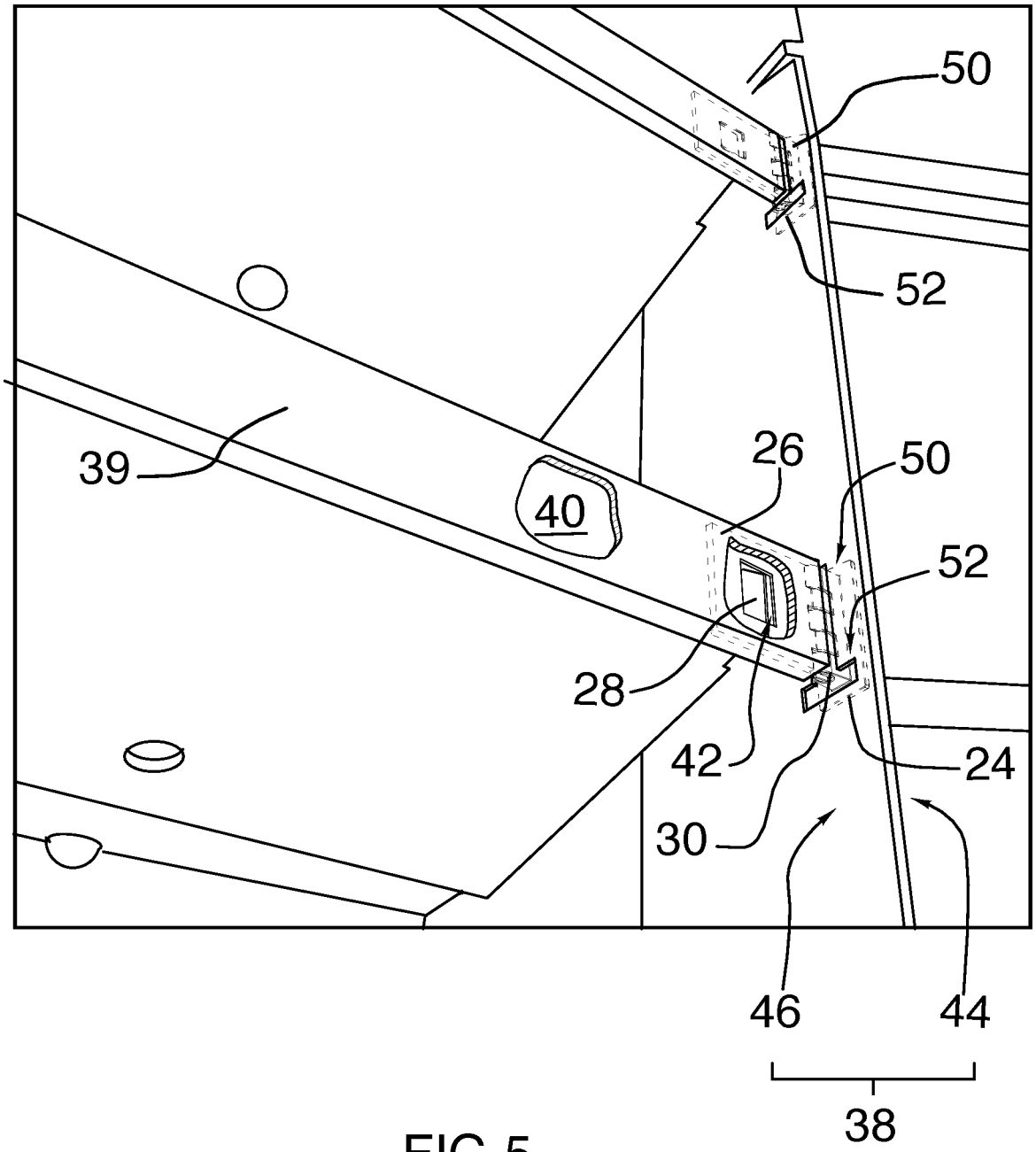
FIG. 5 is a view of a joint according to an embodiment of the invention.

The above apparatus 20 can be used, in combination with a pair of components 36,38, to form a joint as shown in FIG. 5

One of the pair of components 36 will be understood to comprise a cardboard tube having a sidewall 39. A portion of the sidewall is shown cutaway in FIG. 5, which reveals the central chamber 40 of component 36. A further cutaway portion of the sidewall reveals that the sidewall 39 further has defined therein on one side an aperture 42 which communicates with the chamber 40. It will be appreciated that the cutaways are for illustrational purposes only and do not appear in the joint.

The other 38 of the pair of components comprises a pair of cardboard layers 44, 46, one 46 of the layers having defined therewithin a channel 50 and a slit 52 intersecting the channel.

In the joint:

the tab portion 28 is in the engaged position;

the chamber 40 is in gripping receipt of the leaf portion 26, the outline of the leaf portion being shown in dotted outline, for clarity;

the aperture 42 is in gripping receipt of the tab portion 28;

the channel 50 has the one 30 of the pair of parts protruding therefrom and is in close-fitting relation thereto.

Persons of ordinary skill in the art will readily appreciate that, to form the joint:

the leaf portion 26 can be inserted into to the chamber 40, which will cause the tab 28 to deform to the release position until such time as the tab portion 28 reaches the aperture 42 and springs back to grippingly engage the one 36 of pair of components; and the one 30 of the pair of parts can be positioned in the channel by passing the base 24 through the slit 52; the outline of the base 24 is shown in dotted outline in FIG. 5 for clarity.

Structure

Figure 6:
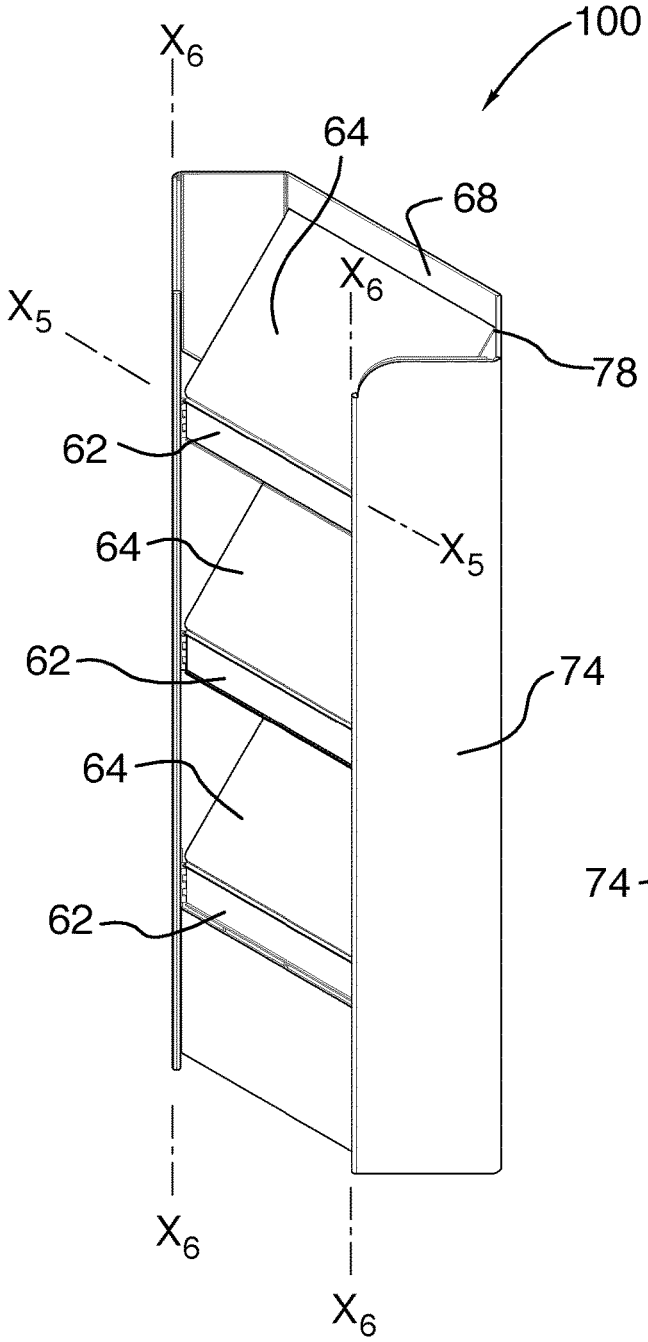
FIG. 6 is a top, front, right side view of a structure according to an embodiment of the invention.
Figure 6A:
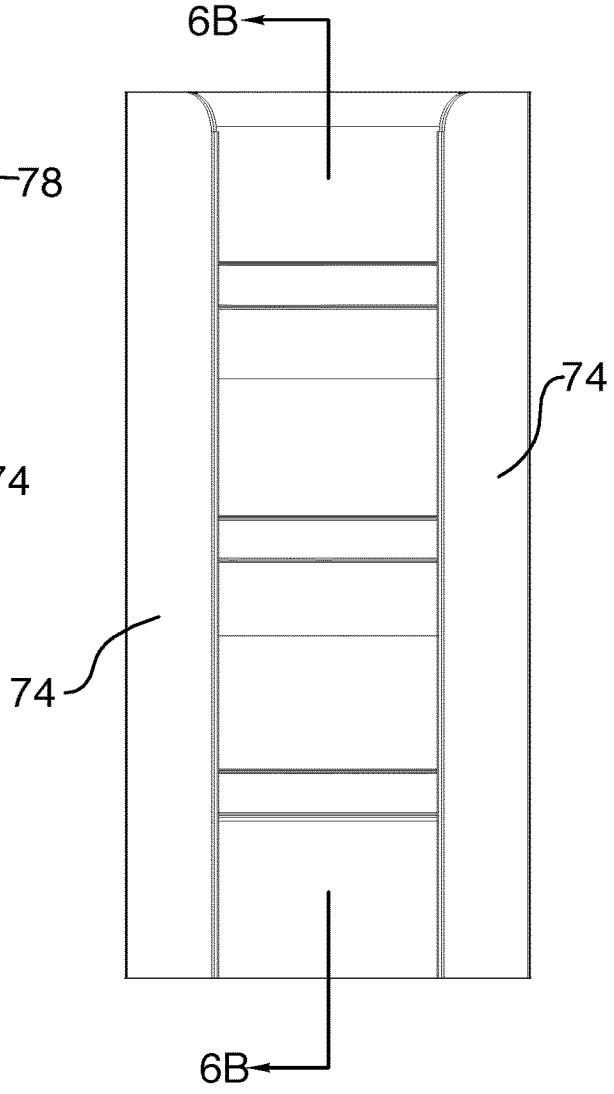
FIG. 6A is a front view of the structure of FIG. 6.
Figure 6B:
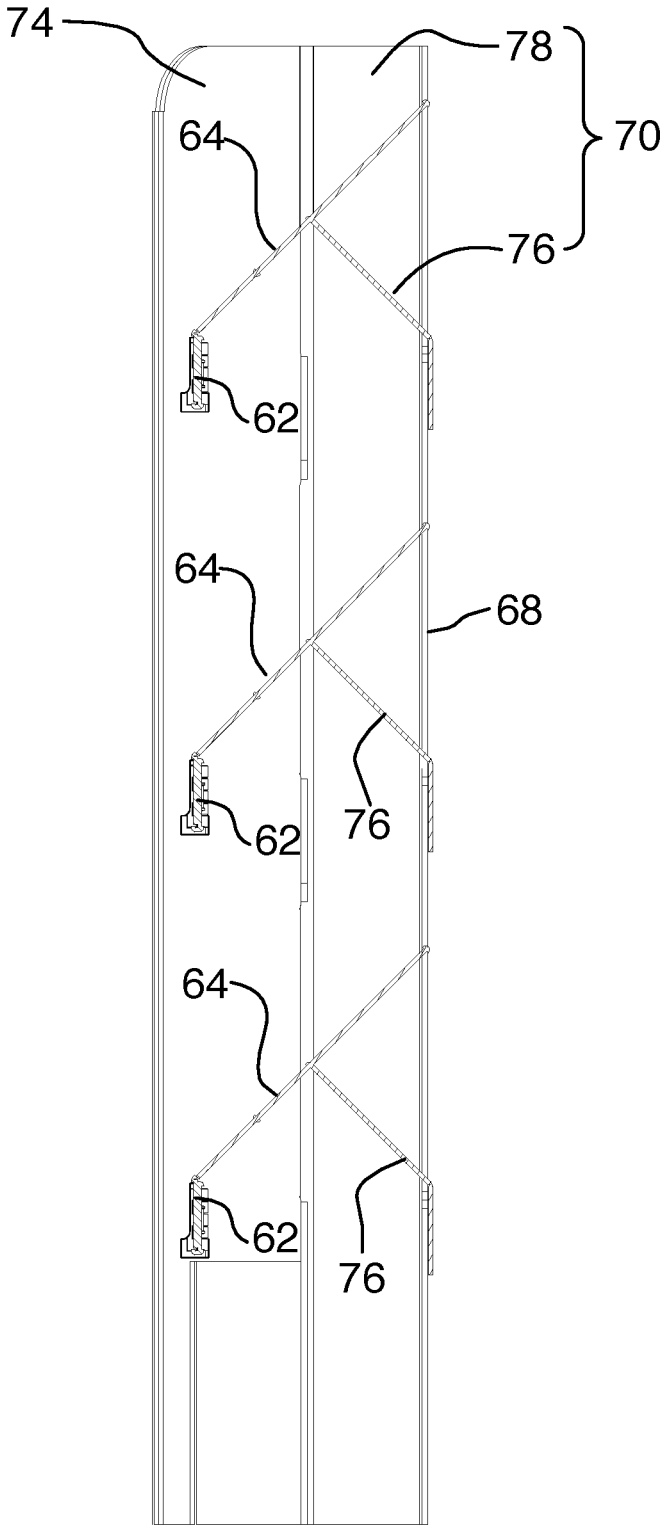
FIG. 6B is a view along section 6B-6B of FIG. 6A.
Figure 6C:
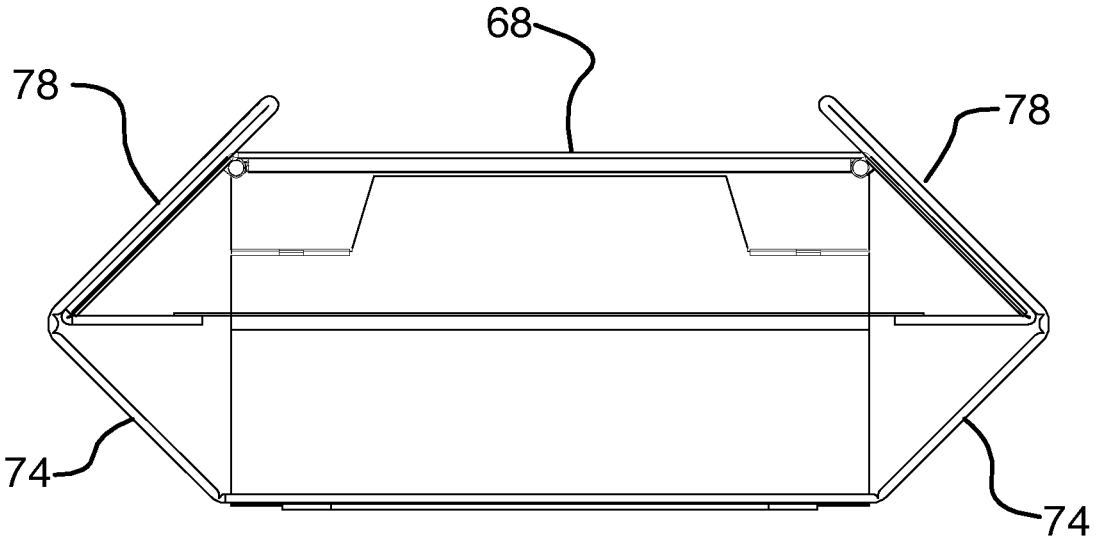
FIG. 6C is a bottom view of the structure of FIG. 6.
Figure 6D:
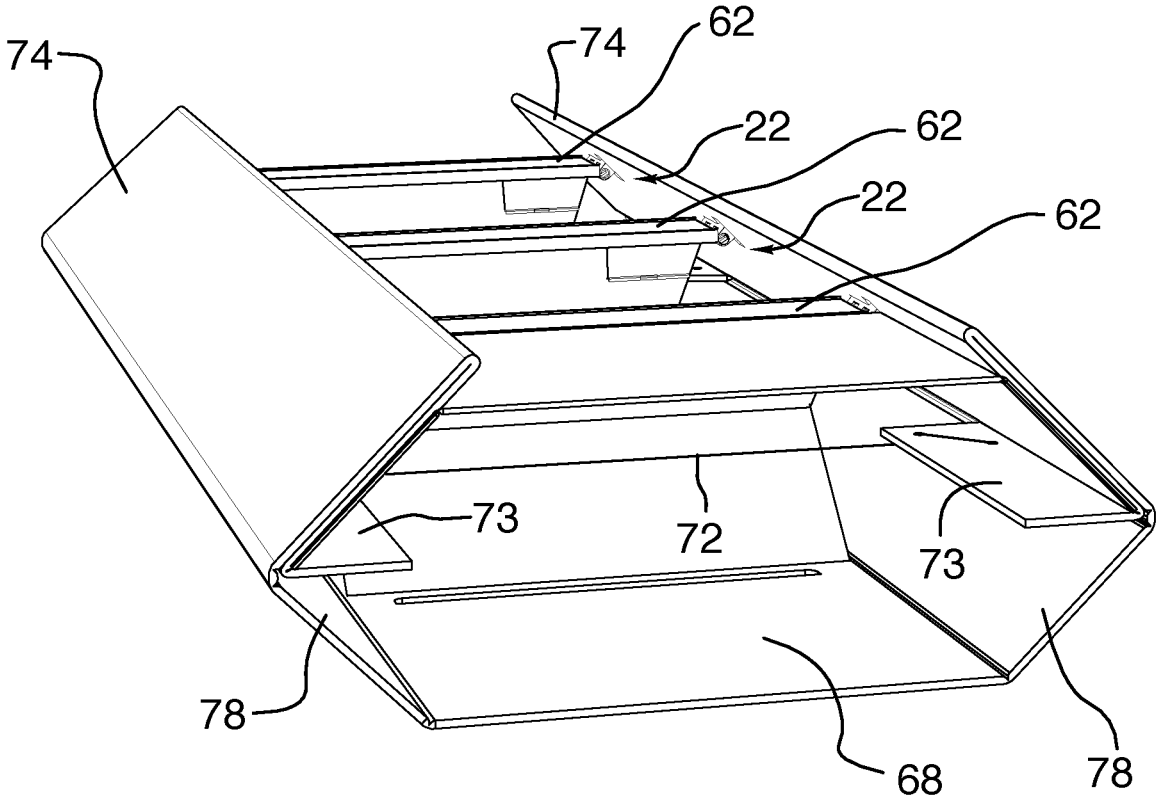
FIG. 6D is a bottom, front, left side view of the structure of FIG. 6.

The above apparatus and joint can be used to form a structure 100, as shown in FIG. 6, that forms another embodiment of the invention.

The structure comprises a plurality of beams 62, a shelf 64 for each beam, a frame 66, a support 68, a linkage 70 and a tensioner 72 for each shelf 64.

The beam 63 is elongate, has a longitudinal axis X5-X5 and a pair of ends, each end defining a pivot axis X6-X6.

Shelf 64 is pivotably connected to beam 62 for movement about the longitudinal axis X5-X5.

The frame includes, for each end of the beam, a sidewall 74, the sidewall connected to the beam end for which it is provided for movement about the pivot axis defined thereby; it will be understood that the hinge and joint of FIGS. 1-5 are used to provide for the connection between the beam and the sidewall, the one of the pair of components being defined by the beam and the other of the pair of components being defined by the sidewall.

The support 68 is planar.

The linkage 70 comprises:

a shelf brace 76 that is planar, extends from the support to a midpoint of the shelf and is pivotally connected to each; and for each sidewall, a planar sidewall brace 78, to which said each sidewall extends and which extends to the support, each sidewall brace 78 being pivotally connected to the sidewall for which it is provided and to the support 68.

The tensioner comprises an elastic member 72 that extends between a pair of flaps 73, the flaps being disposed beneath the shelf and at the junction of the sidewall and the sidewall brace.

Figure 7:
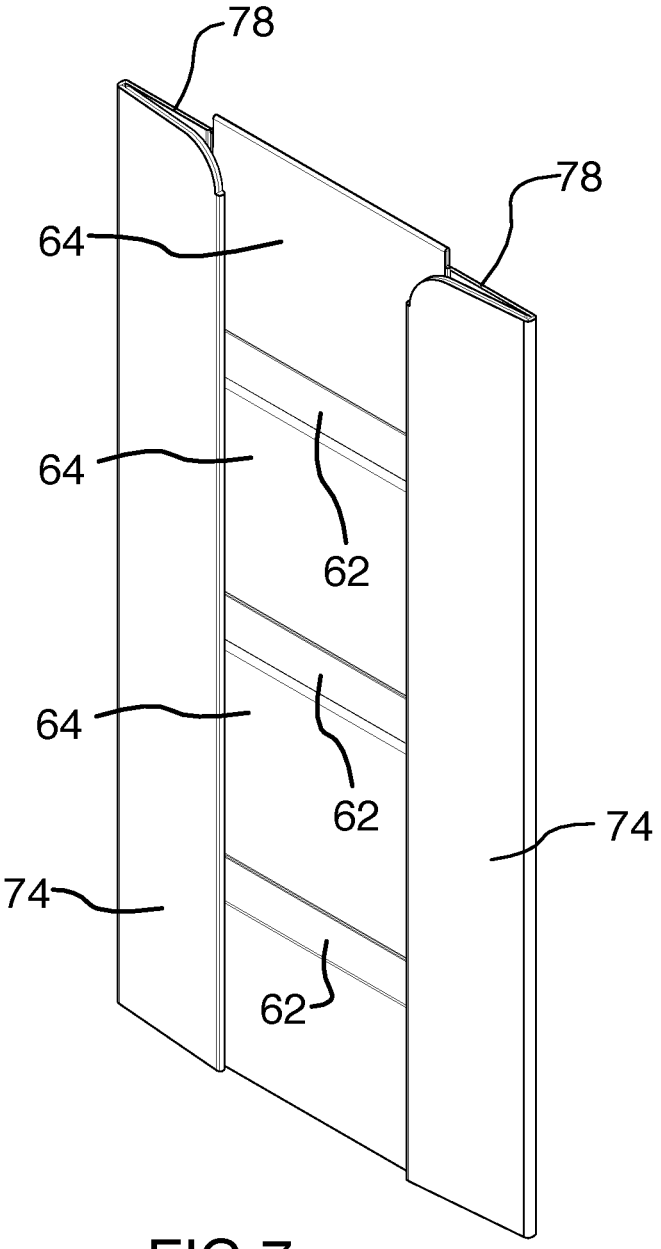
FIG. 7 is a top, front, right side view of the structure of FIG. 6 in a nested configuration.
Figure 7A:
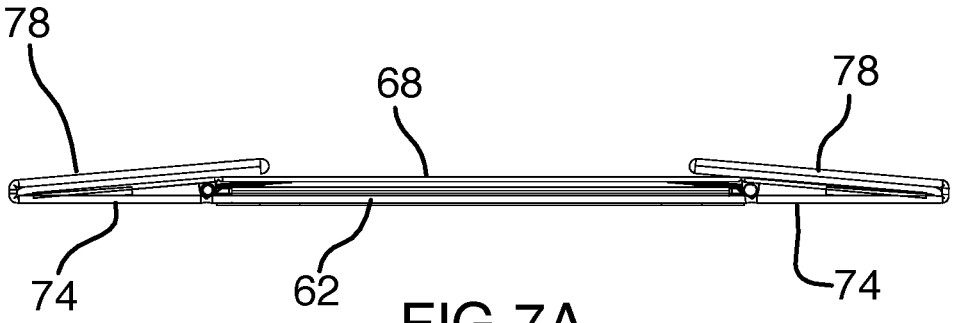
FIG. 7A is a bottom view of the structure of FIG. 7.
Figure 8:
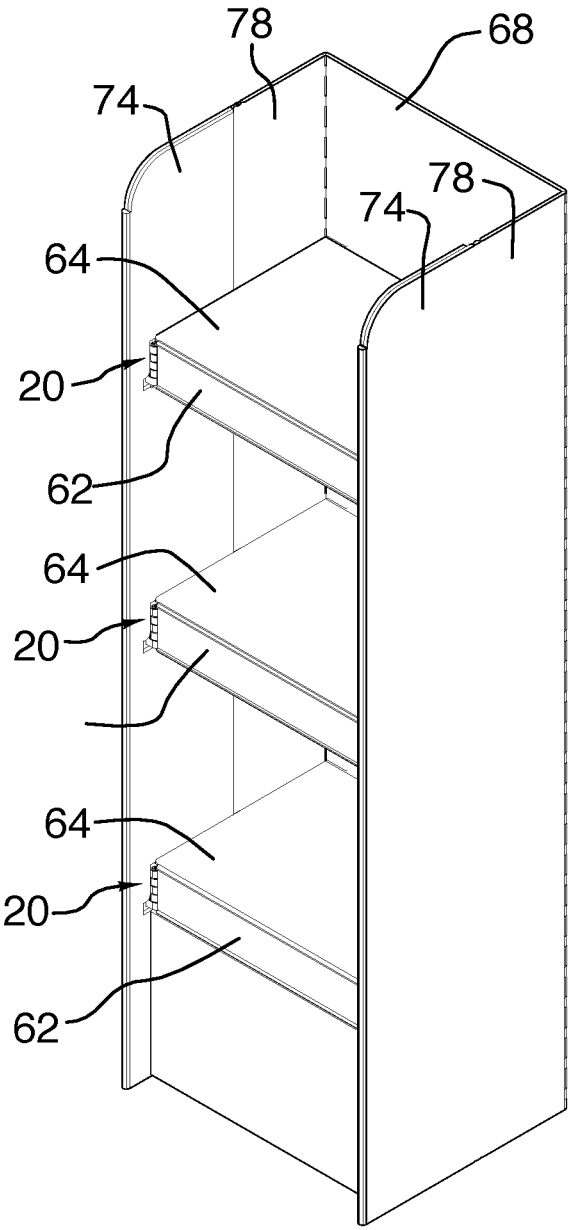
FIG. 8 is a top, front, right side view of the structure of FIG. 6 in a supporting configuration.
Figure 8A:
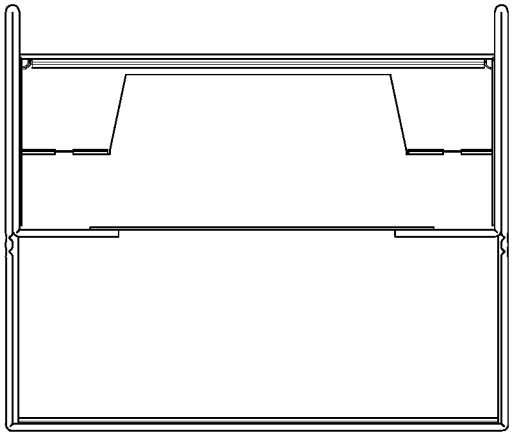
FIG. 8A is a bottom view of the structure of FIG. 8.
Figure 8B:
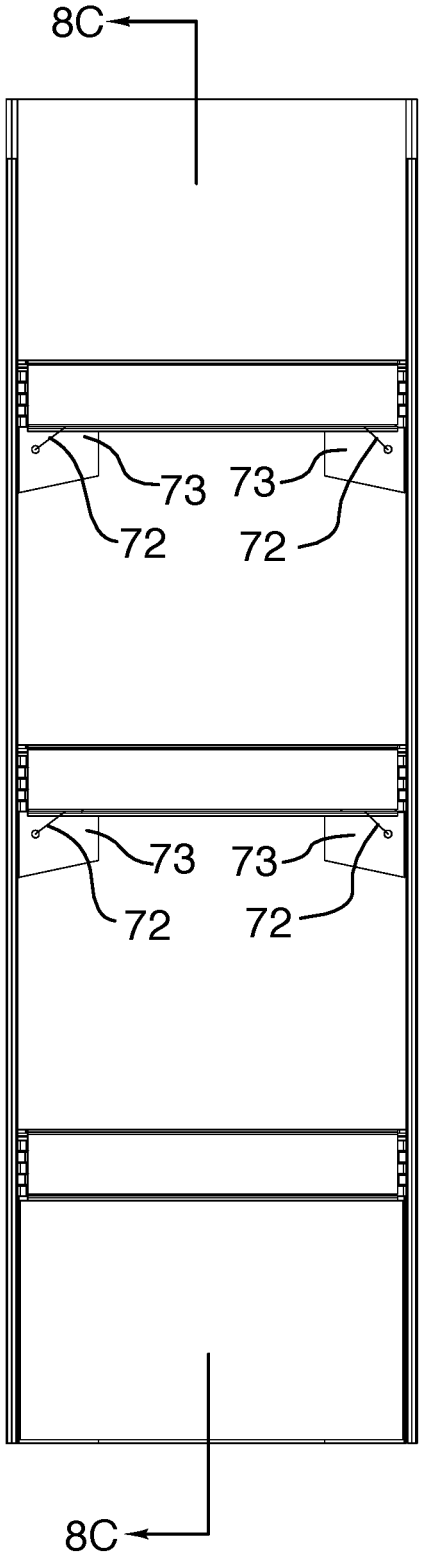
FIG. 8B is a front view of the structure of FIG. 8.
Figure 8C:
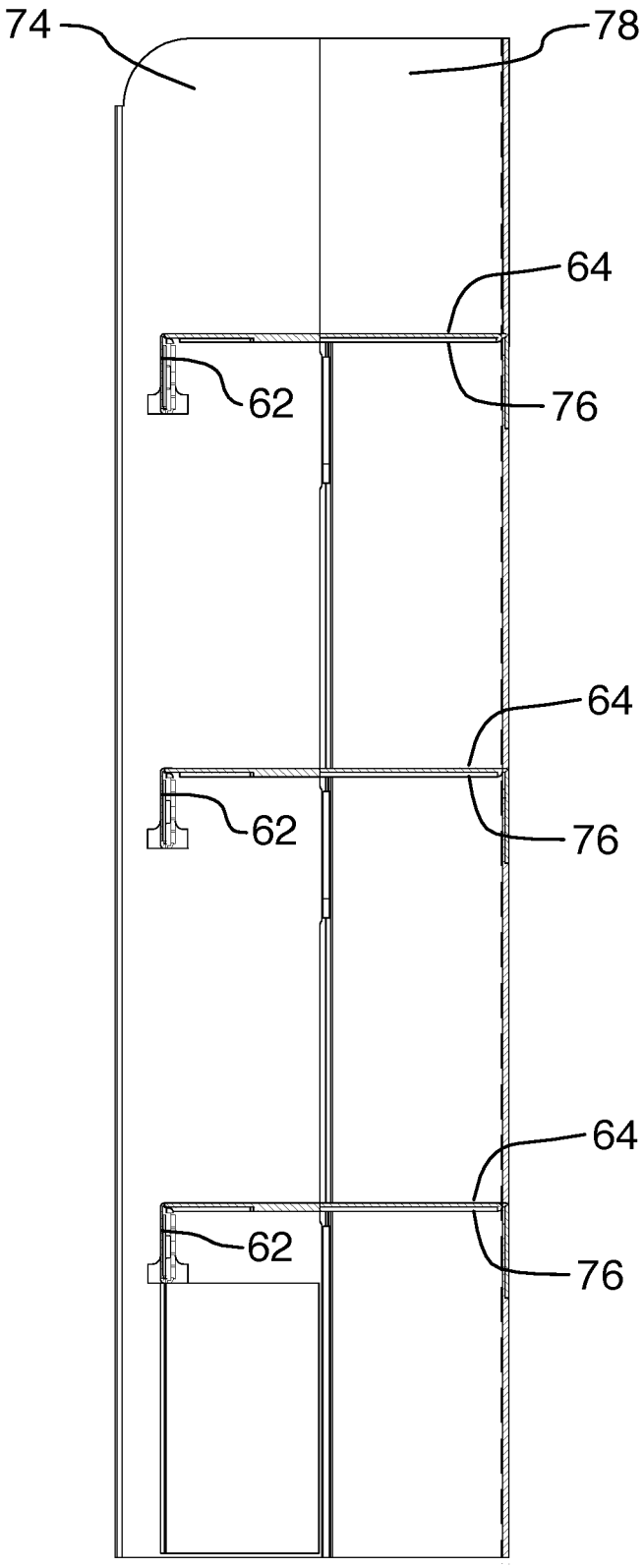
FIG. 8C is a view along section 8C-8C of FIG. 8B.

The usefulness of the structure will be evidenced by the sequence of FIGS. 7,6,8, which shows the structure transitioning between a nested configuration shown in FIG. 7, whereat the shelf is at a nested position, generally coplanar with the beam, each sidewall is at a nested position, generally coplanar with the beam and extending away therefrom and the support is generally coplanar with the beam; and a supporting position shown in FIG. 8 whereat the shelf is disposed in angular relation to the beam, each sidewall is disposed in angular relation to the beam, the support is disposed in parallel, spaced relation to the beam and the shelf is supported by the shelf brace.

In this further regard, it will be appreciated that:

the linkage couples the sidewalls, support and shelf together such that the following movements are mechanically linked to one another: movement of the shelf from the nested position to the supporting position; movement of each sidewall from the nested position to the supporting position; and movement of the support from the nesting position to the supporting position; and the tensioner assists both in movement of the structure to the supporting position and retaining the structure at the supporting position.

Figure 9:
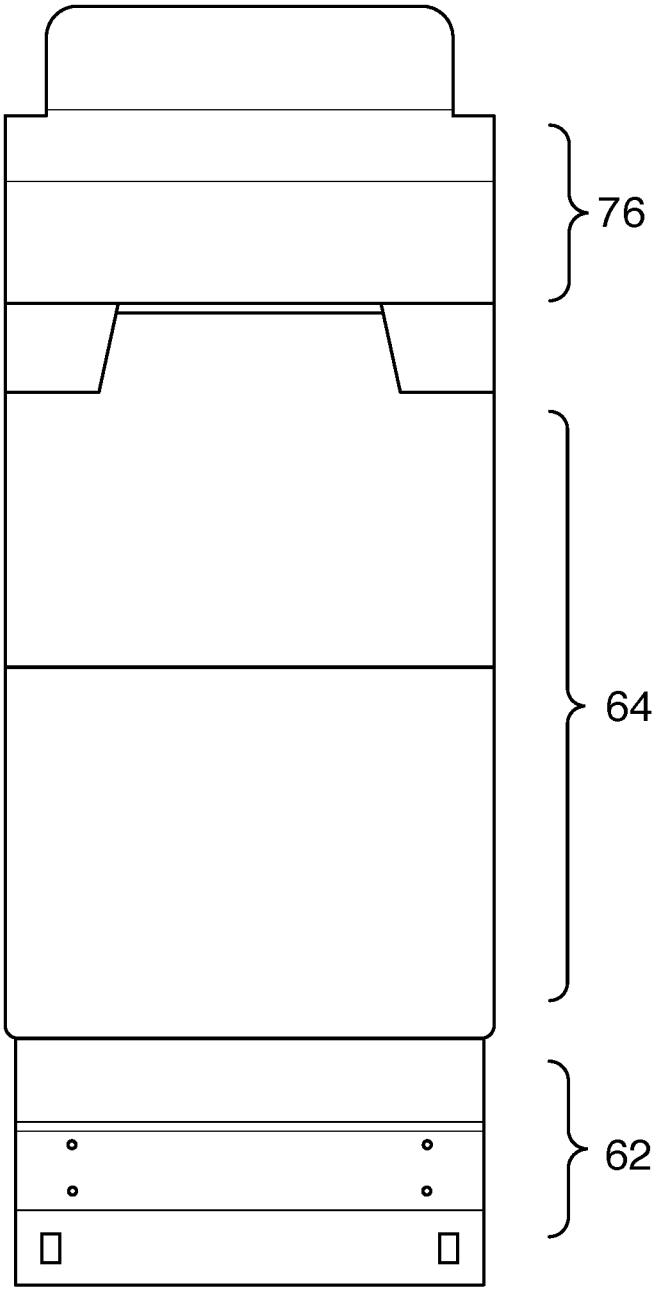
FIG. 9 is a plan view of a blank used to form the structure of FIG. 8.
Figure 10:
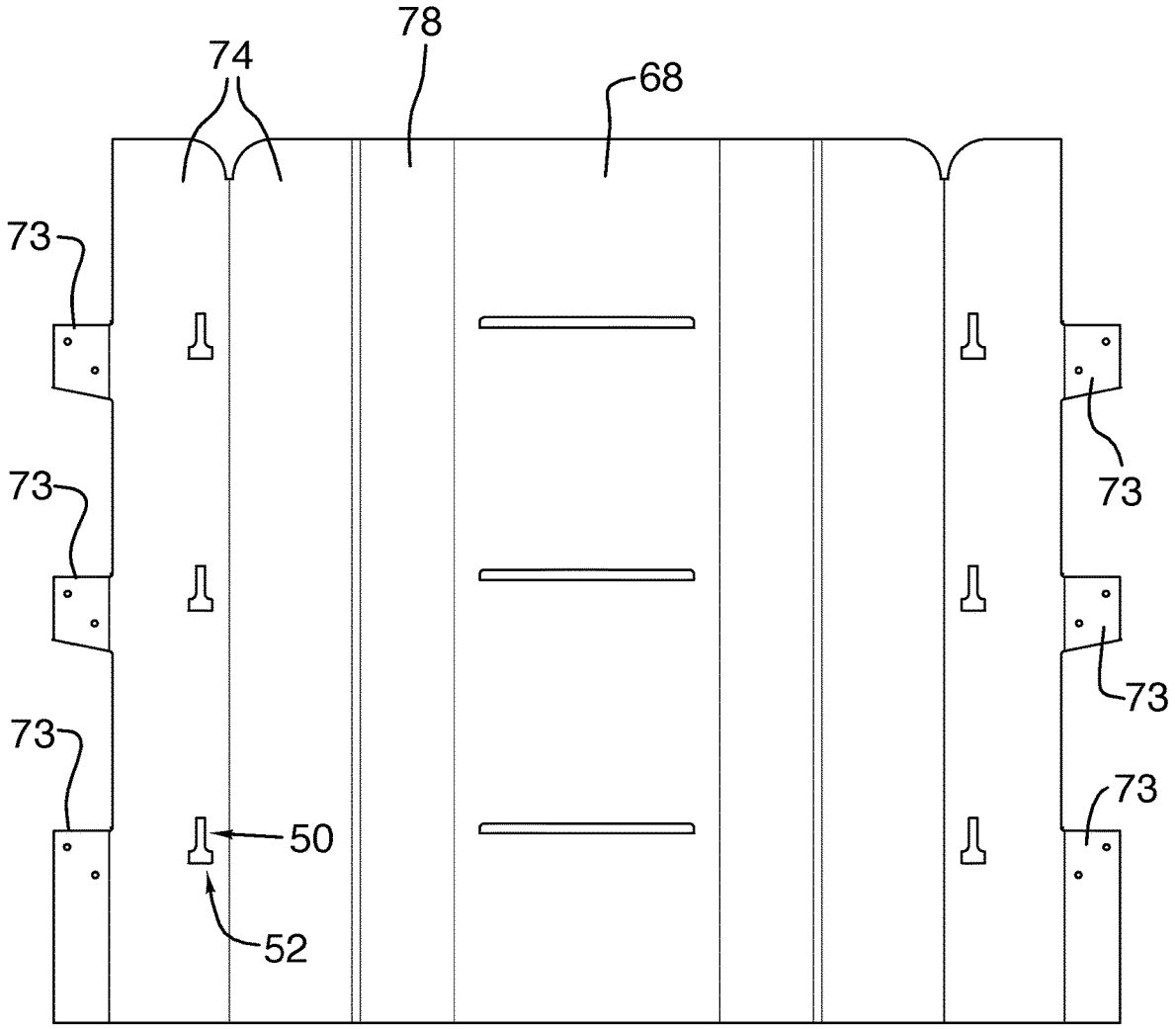
FIG. 10 is a plan view of another blank used to form the structure of FIG. 8.

Persons of ordinary skill will readily appreciate that, but for the hinge and tensioner, the structure can be made cost-effectively out of cardboard: FIG. 9 shows a die for a beam, shelf and shelf-brace; FIG. 10 shows the die for the sidewalls, support and side-wall braces.

Whereas specific embodiments are herein shown and described, variants are possible.

Figure 11:
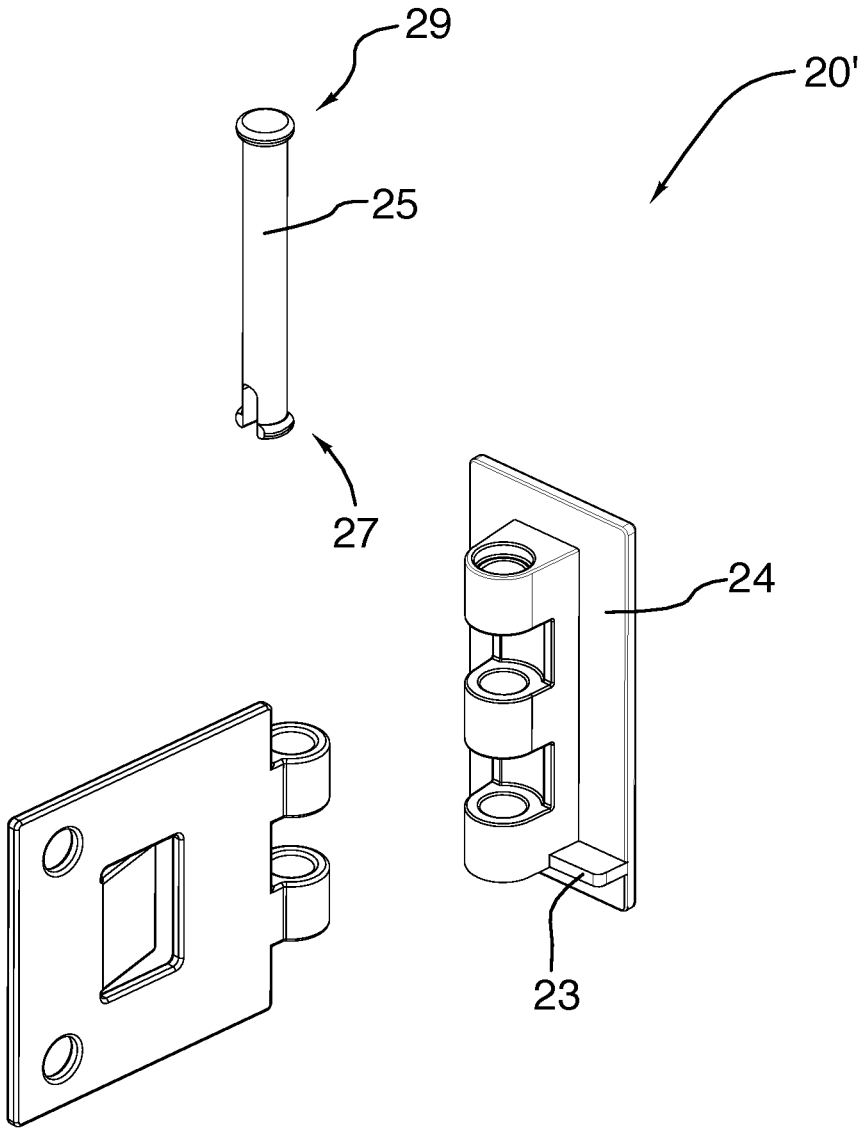
FIG. 11 is a view of an alternate embodiment of the structure of FIG. 1.

FIG. 11 shows an exploded view of a hinge 20' according to one such variant; in this variant, a flange 23 is disposed in transverse relation to the pivot axis and adjacent one (axial) end of the base portion; this flange 23 spreads the load carried by the hinge 20' across a larger surface of the transverse slit, thereby allowing heavier loads to be carried. Herein, a spring pin 25 is also provided; base portion 24 and leaf portion 26 pivot about pin 25 in a conventional fashion. Spring pin 25 has a bifurcated, enlarged end 27 and an enlarged head 29. This allows the spring to be inserted through the bores of the base portion 24 and leaf portion 26; once fully seated, the bifurcated end springs outwardly, to resist withdrawal of the pin in one axial direction; the enlarged head 29 resists withdrawal in the other direction.

Yet further variants are contemplated.

Accordingly, the invention should be understood to be limited only by the accompanying claims, purposively construed.

What is claimed is:

1. A structure comprising:

an elongate beam having a longitudinal axis and a pair of ends, each end defining a pivot axis;

a shelf pivotably connected to the beam for movement about the longitudinal axis between a nested position, whereat the shelf is generally coplanar with the beam; and a supporting position, whereat the shelf is disposed in angular relation to the beam, a frame including for each end of the beam, a sidewall, the sidewall connected to the beam end for which it is provided for movement about the pivot axis defined thereby, between a nested position, whereat the sidewall is generally coplanar with the beam and extends away from the beam; and a supporting position, whereat the sidewall is disposed in angular relation to the beam; and a planar support movable between a nested position, whereat, when the shelf is in the nested position, the planar support is generally coplanar with the beam; and a supporting position, whereat, when the shelf is in the support position thereof, the planar support is disposed in parallel, spaced relation to the beam, a linkage coupling the sidewalls, planar support and shelf together such that the following movements are mechanically linked to one another movement of the shelf from the nested position to the supporting position;

movement of each sidewall from the nested position to the supporting position;

movement of the support from the nesting position to the supporting position;

the shelf extends to, and is supported by, the planar support when the shelf is in the supporting position.

2. The structure of claim 1, wherein the linkage comprises:

a shelf brace extending from the planar support to a midpoint of the shelf and upon which the shelf sits when in its supporting position;

for each sidewall, a sidewall brace, to which said each sidewall extends and which extends to the planar support.

3. The structure of claim 2, wherein the shelf brace is planar and is pivotally connected to each of the shelf and the planar support each sidewall brace is planar and is pivotally connected to the sidewall for which it is provided and to the planar support.

4. The structure of claim 1, wherein a hinge provides the pivotal connection between the beam and the sidewall.

5. The structure of claim 1, wherein a joint defines the connection between the beam and the sidewall.

* * * * *